United States Patent [19]

Okazaki

[11] Patent Number: 4,788,389

[45] Date of Patent: Nov. 29, 1988

[54] FLOW SWITCH VALVE

[75] Inventor: Tatsuo Okazaki, Kamifukuoka, Japan

[73] Assignee: Omco Co., Ltd., Saitama, Japan

[21] Appl. No.: 132,249

[22] Filed: Dec. 14, 1987

[30] Foreign Application Priority Data

Dec. 19, 1986 [JP] Japan ..... 61-303185
Mar. 3, 1987 [JP] Japan ..... 62-48320
Apr. 18, 1987 [JP] Japan ..... 62-58947[U]

[51] Int. Cl.[4] ..... H01H 35/34; H01H 35/40

[52] U.S. Cl. ..... 200/81.9 M; 73/262; 200/307

[58] Field of Search ..... 200/307, 81.9 M, 83 L, 200/82 E, 81.9 R, 83 Q, 83 J; 91/1; 92/5 R; 340/626, 606, 611; 335/205-207; 307/118; 73/723, 728, 861.47, 262, 269, 271

[56] References Cited

U.S. PATENT DOCUMENTS

| | | | |
|---|---|---|---|
| 794,998 | 7/1905 | Mott | 310/218 X |
| 796,702 | 8/1905 | Churchward | 310/218 |
| 879,927 | 2/1908 | Treat | 310/218 |
| 2,172,191 | 9/1939 | Denman | 310/216 |
| 2,229,977 | 1/1941 | Kenyon | 310/194 X |
| 2,449,506 | 9/1948 | Pollard | 310/269 |
| 3,153,157 | 10/1964 | Rabe | 310/194 X |
| 3,441,760 | 4/1969 | Collens | 310/218 X |
| 3,551,620 | 12/1970 | Hoover | 200/81.9 M |
| 3,634,707 | 1/1972 | Tillner | 310/269 X |
| 3,809,938 | 5/1974 | Sjoberg et al. | 310/218 X |
| 4,365,125 | 12/1982 | Keller | 200/81.9 M |
| 4,583,015 | 4/1986 | Toshimitsu | 310/269 X |
| 4,672,253 | 6/1987 | Tajima et al. | 310/269 |
| 4,698,537 | 10/1987 | Byne et al. | 310/269 X |

*Primary Examiner*—G. P. Tolin
*Attorney, Agent, or Firm*—Armstrong, Nikaido, Marmelstein & Kubovcik

[57] ABSTRACT

A flow switch valve including a housing main body comprising a plurality of valve casings stacked contiguously and each having a fluid flow channel and a valve seat member, a valve member passing slidably through said valve casings and having valve bodies corresponding respectively to the valve heat members of the valve casings, a diaphragm disposed to any of the valve casings and supporting the valve member, and a signal generation device for detecting the position of the valve member in the housing main body and generating a detection signal. The valve member moves slidably depending on the change of the fluid pressure in the chamber partitioned by a diaphragm, by which valves for the fluid flow channels in the plurality of valve casings are opened or closed interlocking therewith and, at the same time, a detection signal for the position of the valve member is generated.

5 Claims, 5 Drawing Sheets

FLOW SWITCH VALVE

BACKGROUND OF THE INVENTION

1. Field of the Invention

The present invention concerns a flow switch valve for mechanically controlling the state of a valve disposed in one flow channel by the ON-OFF operation of a faucet disposed in the other flow channel and, more specifically, it relates to a flow switch valve used for the control of a continuous electrolysis type ionized water production device.

2. Description of the Prior Art

An ionized water production device of a so-called continuous electrolysis type (water-running type) that electrolyzes water during supply to an electrolysis vessel having a cathode chamber and an anode chamber and recovers ionized alkaline water and acidic water separately has a water supply pipe for supplying water to the electrolysis vessel and a pair of water discharge pipes for recovering alkaline water and acidic water formed in the electrolysis vessel. A flow switch is disposed to one of the discharge pipes, for example, an alkaline water discharge pipe so as to control the operation of the electrolysis device by the ON-OFF operation of a faucet attached to the top end of the discharge pipe, while a solenoid valve is disposed to the other of the water discharge pipes (acidic water discharge pipe). The flow switch and the solenoid valve are interlocked with each other so that the flow channels for the alkaline water and the acidic water are closed or opened simultaneously.

However, the conventional structure of the above-mentioned type has been expensive in view of the solenoid valve and the electric system for controlling the valve. In addition, the solenoid valve often suffers from the effect of the dust clogging or the voltage or water pressure, thereby causing erroneous operation or failures.

OBJECT OF THE INVENTION

The present invention has been made for overcoming these problems and, accordingly, it is an object thereof to provide a flow switch valve not requiring the use of the solenoid valve and the relevant electrical system and capable of mechanical ON-OFF control for one of the flow channels by utilizing the change in the operating hydraulic pressure of a flow switch connected to the other of the flow channels.

SUMMARY OF THE INVENTION

The foregoing object of the present invention can be attained by a flow switch valve including;

a housing main body comprising a plurality of valve casings disposed which are stacked with each other and each of which is in the shape of a hollow body having a fluid inlet portion and a fluid exit portion partitioned from each other by a valve seat member disposed in the hollow body, a control chamber disposed to the outside of the fluid inlet portion of one of the valve casings by way of a diaphragm, a valve member comprising a shaft supported by the diaphragm and extended passing through the plurality of valve casings and a plurality of valve bodies disposed to the shaft each corresponding to the valve seat member in each of the valve casing, a fluid channel formed through the shaft of the composite valve member so as to communicate the control chamber with the fluid exit portion in one of the valve casings, and a signal generation device for generating a switching signal upon operation of the composite valve member.

BRIEF DESCRIPTION OF THE ACCOMPANYING DRAWINGS

These and other objects, as well as the advantageous features of the invention will become apparent by referring to the following detailed descriptions in conjunction with the accompanying drawings, in which.

DETAILED DESCRIPTION FOR PREFERRED EMBODIMENTS

Figure 1:
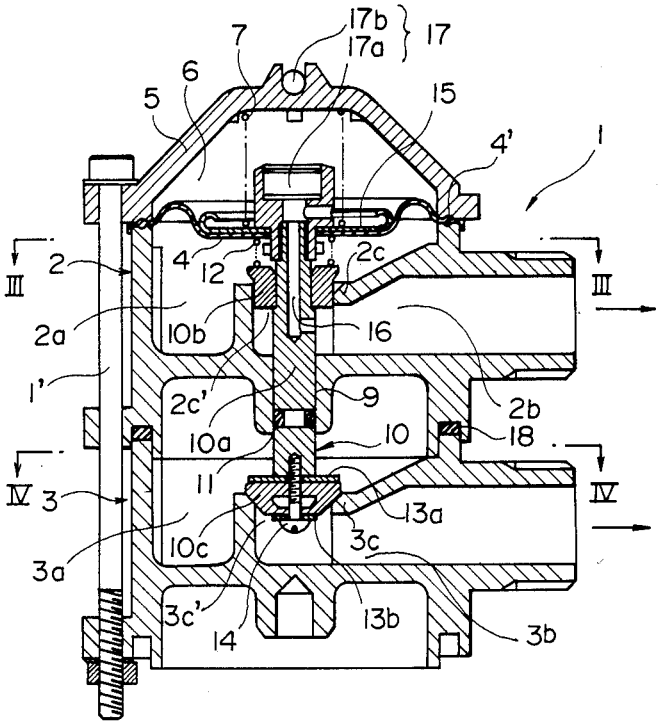
FIG. 1 is a cross sectional view for a flow switch valve as one embodiment according to the present invention, taken along line I—I in the following FIG. 2.
Figure 2:
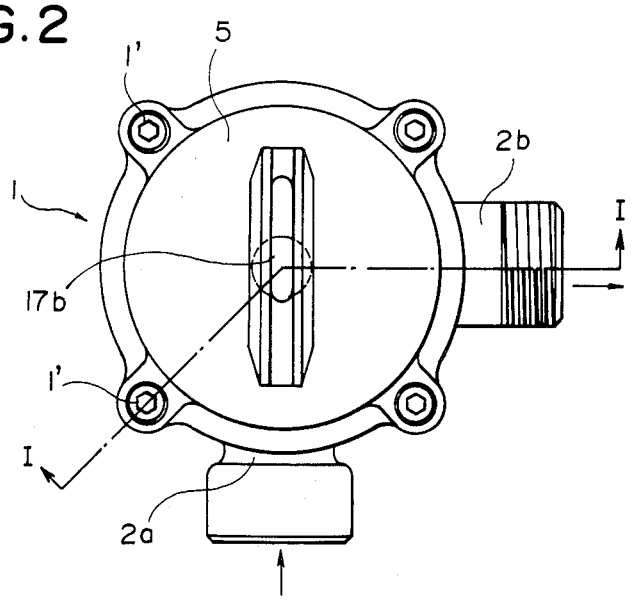
FIG. 2 is a plan view for the flow switch valve.

The present invention will be described specifically by way of preferred embodiments referring to the drawings. In FIGS. 1 through 4, a housing main body 1 for a flow switch valve comprises a plurality of valve casings 2, 3 stacked axially and combined integrally with each other, each having a fluid inlet portion and a fluid exit portion, in which separate fluid pipe ways can be connected to the respective valve casings 2 and 3.

Figure 3:
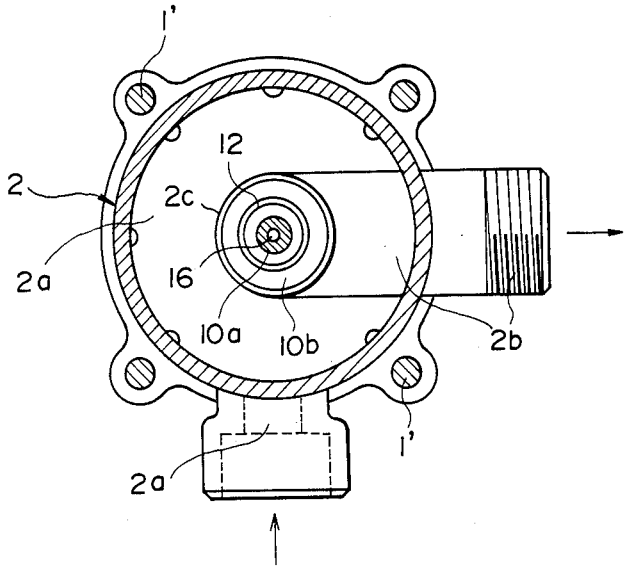
FIG. 3 is a transversal cross sectional view taken along line III—III in FIG. 1.
Figure 4:
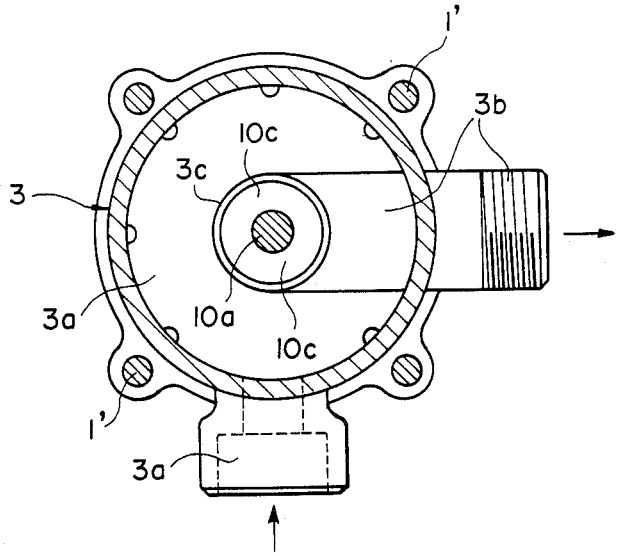
FIG. 4 is a transversal cross sectional view taken along line IV—IV in FIG. 1.

As shown in FIG. 1 and FIG. 3, a valve casing 2 (hereinafter referred to as the first valve casing) in the form of a hollow body contains a fluid inlet portion 2*a* and a fluid exit portion 2*b*, and a valve seat member 2*c* for partitioning these portions 2*a* and 2*b* at the central part of the hollow portion. Also as shown in FIG. 1 and FIG. 4, the other valve casing 3 (hereinafter referred to as the second valve casing) also contains a fluid inlet portion 3*a* and a fluid exit portion 3*b*, and a valve seat member 3*c* for partitioning these portions 3*a* and 3*b* at the central part of the hollow portion.

Above the fluid inlet portion 2*a* of the first valve casing 2 (valve casing at the upper stage in this illustrated example), a diaphragm 4 made of flexible material such as rubber is resiliently disposed transverse to the casing 2 and a cap member 5 is disposed further thereabove to constitute a control chamber 6 in contiguous with the outside of the casing 2 while being partitioned by the diaphragm 4. The diaphragm 4 is resiliently supported by means of a spring 7.

A shaft 10*a* is secured at the center of the diaphragm 4 and it is extended passing through the port 2*c*′ in the valve seat member 2*c* of the first valve casing 2, further passed through the partition frame 9 between the first and the second valve casings 2 and 3 slidably and in a liquid seal manner toward the port 3*c*′ in the valve seat member 3*c* of the second valve casing 3. The shaft 10*a* is provided with a first valve body 10*b* that enters into and retracts from the port 2*c*′ in the valve seat member 2c for the control of the fluid communication and a second valve body 10c for the ON-OFF control of the port 3c' in the valve seat member 3c, which constitutes, as a whole, a valve member 10 such that the port 2c' and 3c' can be put to ON-OFF control simultaneously.

An O-ring 11 is tightly fitted to the outer circumference of the shaft 10a that slides against the partition frame 9 for maintaining a liquid seal between the first and the second valve casings 2 and 3.

It is desirable that a slight gap is left between the first valve body 10b and the port 2c' in the valve seat member 2c when the former is inserted into the latter. While the first valve body 10b is resiliently held by the spring 12 in the illustrated embodiment for smooth operation, the structure is not restricted only thereto but the valve body may be secured to the shaft 10a. Further, the second valve body 10c is preferably put between reinforcing plates 13a and 13b at both of the upper and the lower surfaces of a packing member and secured to the shaft body 10a by means of a screw 14.

The diaphragm 4 moves vertically integral with the valve member 10 depending on the change in the inner pressure of the housing main body 1 to be described later and, for this purpose, a reinforcing plate 15 is joined to the upper and/or lower surface of the diaphragm 4. This can prevent the distortion of the diaphragm made of rubber and also improve the balance thereof as a pressure receiving plate. Further, the reinforcing plate 15 disposed to the upper surface of the diaphragm 4 is preferably turned back in a circular form at the circumferential edge thereof as shown in FIG. 1 so that wear or crack caused by the vertical movement of the diaphragm 4 can be prevented. Furthermore, the effective pressure receiving area of the diaphragm 4 is mad greater than that of the second valve 10c (upper surface in the drawing).

The shaft 10a of the valve member 10 is perforated with a fluid channel 16 for communicating the control chamber 6 with the fluid exit portion 2b of the first valve casing 2, so that fluid may flow from the fluid exit portion 2b of the first valve casing 2 to the control chamber 6 or flow in the direction due to the relative change in the pressure between the fluid exit portion 2b in the first valve casing 2 and the control chamber 6.

Further, a signal generation device 17 is disposed to the flow switch valve according to the present invention for generating a switching signal by the operation of the composite valve member 10. In the illustrated embodiment, the signal generation device 17 comprises a magnet 17a secured at one end of the valve member 10 and a reed switch 17 disposed to the housing main body 1 corresponding thereto and along the axial extension of the valve member 10. The device is adapted such that a signal, for example, a control signal for an electrolysis device is generated from the reed switch 17b depending on the change in the magnetic field when the magnet 17a of the valve member 10 is brought closer to or aparted from the reed switch 17b.

In the signal generation device used for the flow switch valve of the present invention, if the moving stroke of the valve member 10 required for the switch ON-OFF operation is too long, it may cause deviation for the timing between the valve ON-OFF operation and the signal generation to lower the accuracy. Accordingly, it is desirable that the switch can be turned ON or OFF to generate a detection signal even upon a slight movement of the valve member 10.

Figure 5:
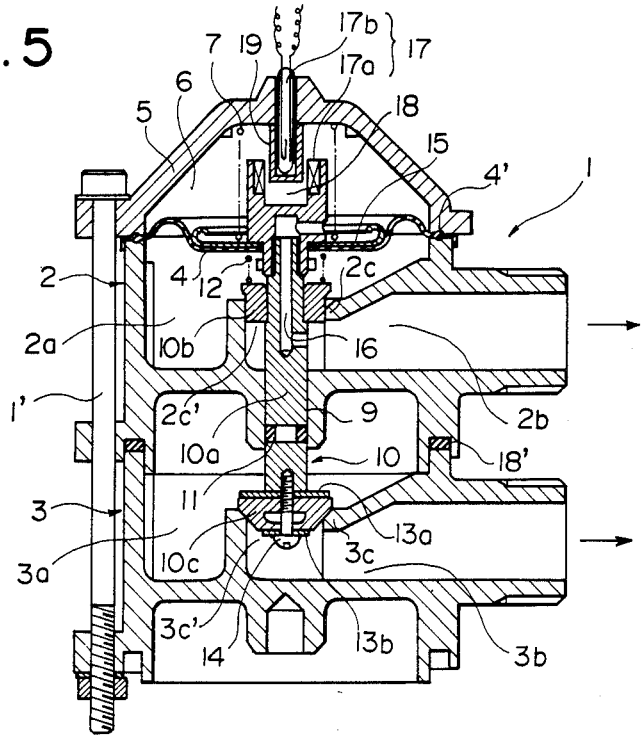
FIG. 5 through FIG. 8 are, respectively, vertical cross sectional views for other embodiments according to the present invention.

A further improved embodiment for satisfying such a requirement is shown in FIG. 5, in which a switch member such as a reed switch 17b mounted to the housing main body 1 is protruded toward the inside of the housing main body 1, while the magnet 17a mounted to the valve member 10 opposed to the switch member is formed as a hollow ring-like or recessed member such that the magnet surrounds the outside of the protruding portion of the lead switch 17b by way of a hollow portion 18.

In the embodiment shown in FIG. 5, a switch support portion 19 formed on a housing cap member 5 is protruded inwardly in which a lead switch 17b is longitudinally held, such that the lead switch 17b may partially or fully extended to the inside of the housing main body 1. While on the other hand, the magnet 17a is formed as a hollow ring-like shape so that it may move opposing to the outer periphery of the lead switch 17b upon reciprocal movement of the valve member 10.

Figure 6:
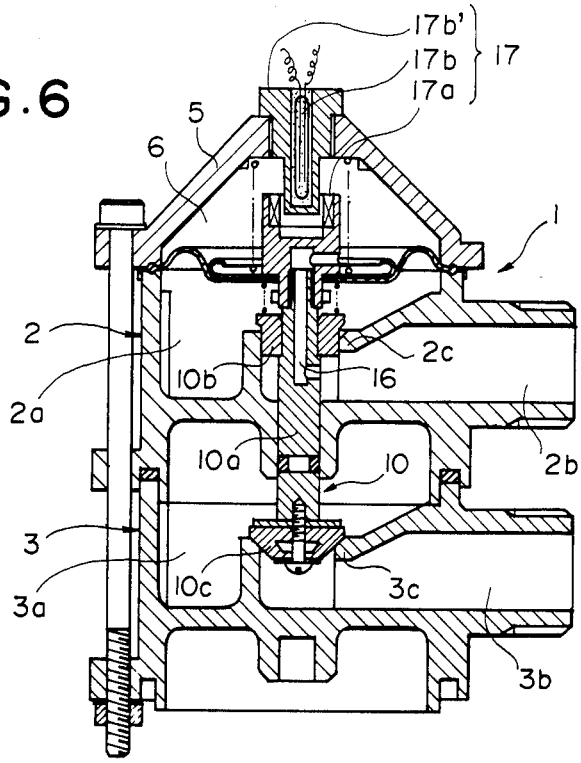
Figure 7:
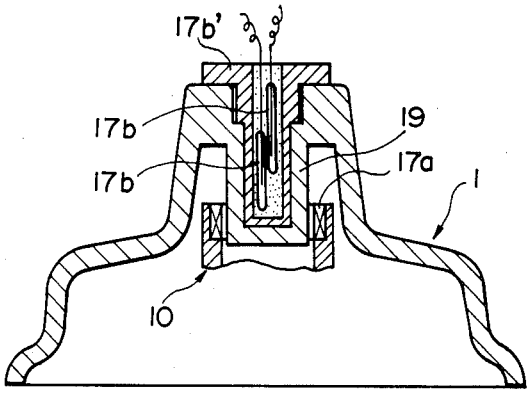

FIG. 6 and FIG. 7 show other embodiments of the signal generation device for use in the flow switch valve of the present invention. In the signal generation device 17, a switch element 17b such as a reed switch is previously enhoused to the inside of a cassette 17b' and a mounting portion is formed to a predetermined position of the valve casing 2 for detachably mounting the cassette 17b'. The cassette 17b' incorporating the switch 17b is detachaly mounted to the mounting portion by fastening means such as threading or fitting engagement. The switch 17b is preferably molded with an epoxy resin or the like and situated to secure in the cassette 17b'.

The mounting portion for the cassette 17b' may be a through hole formed in the valve casing 2 as shown in FIG. 6 or such a structure in which a switch support portion 19 like that shown in FIG. 5 is formed at a predetermined position of the valve casing 2 is shown in FIG. 7. The cassette may be mounted by adequate means as described above.

In the illustrated embodiment, the lower portion of the longitudinally formed cassette 17b' is protruded to the inside of the casing 2, while a hollow magnet 17a is secured to the top of the valve member 10, such that the magnet 17a of the valve member 10 may move vertically along the axis of the cassette 17b' by the vertical movement of the diaphragm 15. Such a structure is extremely effective for taking a timing between the ON-OFF operation of the valve member 10 and the ON-OFF signal from the signal generation device 17 and for improving the accuracy for the switching operation. However, the present invention is no way restricted only to such a structure but it may be constituted such that the cassette is formed shorter, while a block-magnet is disposed to the top end of the valve body, so that the magnet is brought closer to or aparted form the opposed lower end of the cassette, although not illustrated.

Figure 8:
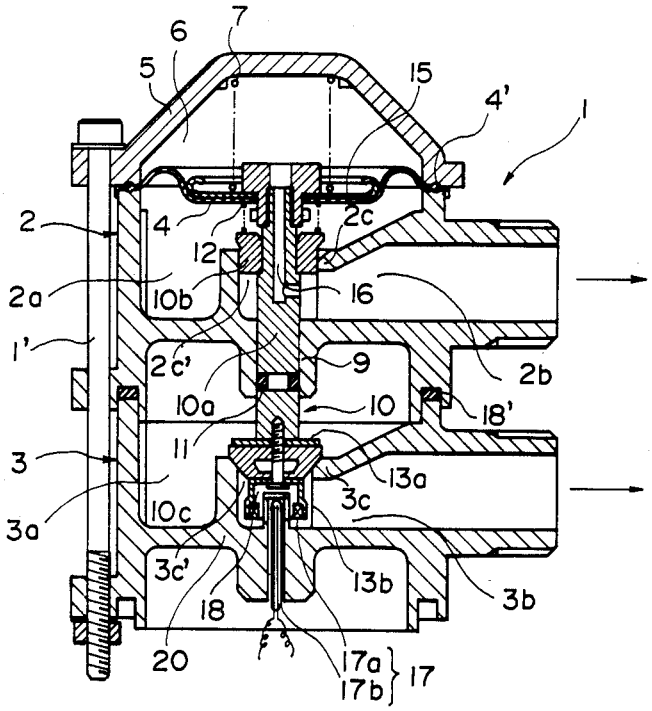

In each of the embodiments shown in FIGS. 1 through 7, the reed switch 17b is disposed to the cover member 5 of the housing main body 1 while the magnet is mounted to the top end of the opposing valve member. However, the constitution is no way restricted only thereto but it may alternatively be constituted as shown in FIG. 8, in which the magnet 17a is mounted to the lower end of the valve member 10, while the reed switch 17b is disposed to the opposing bottom member 20 of the housing 1.

Further, the constitution of the signal generation device is not restricted only to that shown in the drawing but a limit switch such as a micro-switch that turns 0N and OFF electric contacts by the reciprocal movement of the shaft 10*a* of the valve member 10 may be used, although it is not illustrated.

In addition, since the flow rate is increased in proportion with the moving stroke of the valve member 10, a signal generation device that detects the change in the magnetic field from the magnet 17 depending on the movement of the stroke and generates a signal at an output in accordance with the flow rate may be used. In this case, two switching members 17*b* are disposed at two stages displaced from each other in the cassette 17*b*' as shown in FIG. 7, so that switch ON signals are generated as a half-wave rectified signals or a full-wave rectified signal separately depending on the position of the magnet 17*b* of the valve member 10.

The flow switch valve according to the present invention is preferably manufactured by stacking a plurality of unit members each of an identical shape in the axial direction by means of an ON-ring 18 as shown in the drawing, thereby forming a plurality of valve casings 2, 3, putting the peripheral edge of the diaphragm 4 between the valve causing 2 at the uppermost stage and the cap member 5 and combining the cap member 5 and a plurality of the unit members integrally with four bolts 1, 1', - - - . In this case, ribs 4' also serving as an 0-ring are integrally formed to the surfaces for putting the diaphragm 4 there- between.

Operation of the Flow Switch Valve

Explanation will be made to one example of application use and the operation of the flow switch valve according to the present invention, when it is used in connection with alkaline water and acidic water discharge pipes from an ionized water producing device by continuous electrolysis.

Figure 9:
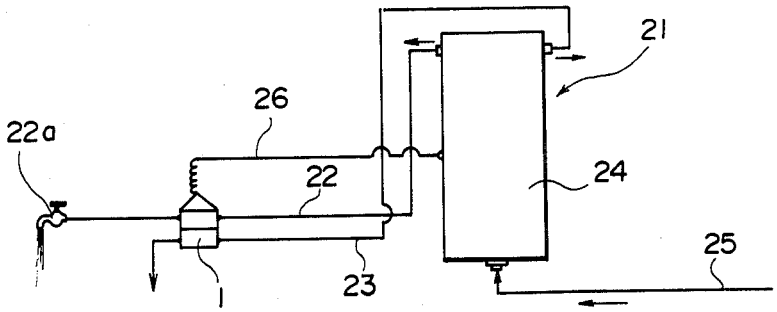
FIG. 9 is an explanatory view for the state of using the flow switch according to the present invention when applied to an ionized water producing device by continuous electrolysis.

As shown in FIG. 9, a continuous electrolysis type ionized water production device 21 has an alkaline water discharge pipe 22 and an acidic water discharge pipe 23, in which the operation of the electrolysis device and the ON-OFF of the acidic water discharge pipe 23 are controlled by the ON-OFF operation of a faucet 22*a* attached to the alkaline water discharge pipe 22. In this embodiment, water in the alkaline water discharge pipe 22 flows from the inlet portion 2*a* of the first valve casing 2 of the housing main body 1 of the flow switch valve, while water in the acidic water discharge pipe 23 flows from the inlet portion 3*a* of the second valve casing 3 to the exit portion 3*b*. In the drawing, 25 denotes a water supply pipe for continuously supplying water to an electrolysis vessel 24 of the production device 21 and 26 denotes an electrical wiring for signal transmission.

In the state shown in FIG. 1, the faucet 22*a* for alkaline water is closed. Under this condition, both of the ports 2*c*', 3*c*' for the alkaline water and acidic water are closed by the valve bodies 10*b*, 10*c* of the valve member 10, and the inner hydraulic pressures in the fluid inlet portion 2*a* and the exit portion 2*b* of the first valve casing 2 and in the control chamber 6 are kept equal with each other. Further, in this state, the cathode and the anode (not illustrated) disposed in the electrolysis vessel 24 of the ionized water producing device is electrically kept OFF from each other.

When alkaline water is taken out by opening the faucet 22*a*, since the pressure in the exit portion 2*b* of the first valve casing 2 is relatively lowered, the alkaline water in the control chamber 6 flows out through the fluid channel 16 of the valve member 10 to the exit portion 2*d* and, as a result, the pressure inside the control chamber 6 is lowered relative to the inlet portion 2*a* of the first valve casing 2. Therefore, the diaphragm 4 and the valve member 10 integral therewith are pushed up in the drawing against the resiliency of the spring 7. In this case, the pressure at the same level as that for the inlet portion 2*a* of the first valve casing 2 is also exerted to the inlet portion 3*a* of the second valve casing 3. However, since the pressure receiving area of the diaphragm 4 is made greater than that of the valve body 10*c* of the second valve casing 3, the uprising force of the diaphragm 4 becomes predetermined and the valve member 10 displaces upwardly to open the ports 2*c*', 3*c*' of the first and the second valve casings 2 and 3, causing both of the alkaline water and acidic water to flow out. At the same time, since the magnet 17*a* attached to the top end of the valve member 10 moves by the displacement of the valve member 10 relative to the lead switch 17*b*, a switching signal is generated to electrically conduct the electrodes in the electrolysis vessel 24 by means of a not illustrated relay to start the electrolytic operation.

Then, when the faucet 22*a* for the alkaline water is closed, the pressure in the exit portion 2*b* of the first valve casing 2 is elevated and the alkaline water in the inside flows through the channel 16 in the valve member 10 to the inside of the control chamber 6 which is at a relatively low pressure state. As a result, the diaphragm 4 and the valve member 10 integral therewith are pushed downwardly in the drawing along with the pressure rise in the chamber 6, by which the port 3*c*' of the second valve casing 3 is closed by the valve body 10*c* to interrupt the flow of the acidic water. At the same time, since the valve member 10 is displaced downwardly, the magnet 17*a* at the top end thereof is aparted from the lead switch 17*b*. Accordingly, a signal is turned by the change in the magnetic field to electrically disconnect the electrodes in the electrolytic vessel 24.

While the valve body 10*b* gradually restricts the port 2*c*' of the first valve casing 2 by the downward displacement of the valve member 10, since there is a fine gap between the valve body 10*b* and the port 2*c*', inner pressures in the fluid inlet portion 2*a* and the exit portion 2*b* of the first valve casing 2 and the control chamber 6 are settled equal to each other. Accordingly, upon next ON-OFF operation to the faucet 22*a*, the same operation as described above can be obtained.

As has been described above in the flow switch valve according to the present invention, since the ON-OFF control for one flow channel can be attained by the ON-OFF control for the other flow channel with no requirement of using solenoid valve and relevant electric system and the control can be made in a simple and compact structure mechanically, the device cost can be decreased and the assembling work to the elctrolysis device or the like can be facilitated. Further, since the valve is not clogged and is free from the effect of voltage, etc. it is extremely useful in preventing erroneous operation or failure.

Further, in the modified embodiment as shown in FIG. 5 and FIG. 8 in which the lead switch and the magnet of the signal generation device are fitted with each other such that the magnet is displaced along the periphery of the lead switch, since the ON-OFF signal of the valve can be detected even by a slight movement of the magnet, the accuracy for the valve OF-OFF signal can be improved significantly.

Furthermore, in another embodiment in which a cassette enhousing a signal generation device is made detachable from the casing, the replacement of the switch member can be facilitated to make the maintenance work easier, as well as it is also possible to utilize the function of the flow switch valve in various ways, for example, by changing the single step switch to the multi-step switch, from the two lead wire switch to the three lead wire switch, etc.

Furthermore, since a plurality of valve casings can be formed by the combination of units each of an identical shape, the kind of parts can be decreased and the manufacture can be facilitated.

What is claimed is:

1. A flow switch valve comprising:

a housing main body including a plurality of valve casings which are stacked contiguously with each other, and each of which is in the shape of a hollow body having a fluid inlet portion and a fluid exit portion partitioned from each other by a valve seat member disposed in the hollow body, a control chamber disposed to the outside of said fluid inlet portion of one of said valve casings by way of a diaphragm resiliently supported on said casings, a valve member comprising a shaft supported by said diaphragm and extended and passing through the plurality of said valve casings and a plurality of valve bodies disposed to said shaft, each corresponding to said valve seat member in each of said valve casings, a fluid channel formed through the shaft of said valve member so as to communicate said control chamber with the fluid exit portion in one of said valve casings, and a signal generation device for generating a switching signal upon a predetermined movement of said valve member.

2. A flow switch valve as defined in claim 1, wherein the signal generation device comprises a magnet mounted on one side of the valve member and reed switch mounted to the housing main body of the flow switch valve so as to be opposed to said magnet.

3. A flow switch valve as defined in claim 2, wherein the reed switch mounted to the housing main body is protruded toward the inside of said housing main body, while a recessed or hollow portion is formed to the magnet on the valve member for receiving said reed switch, and said magnet is disposed to the outside of said reed switch by way of said hollow portion.

4. A flow switch valve as defined in any one of claims 1 to 3, wherein the signal generation device is enhoused in a cassette, which is detachably mounted to a mounting portion disposed on the casing main body.

5. A flow switch valve as defined in any one of claims 1 to 3, wherein a plurality of the valve casings are constituted by stacking a plurality of frame units each of an identical shape with each other.

* * * * *